US005213297A

United States Patent [19]

Laskowski

[11] Patent Number: 5,213,297

[45] Date of Patent: May 25, 1993

[54] TIRE DISPLAY DEVICE

[75] Inventor: Len Laskowski, Lockport, Ill.

[73] Assignee: Ready Metal Manufacturing Company, Chicago, Ill.

[21] Appl. No.: 704,604

[22] Filed: May 23, 1991

[51] Int. Cl.[5] ..... A47F 7/00

[52] U.S. Cl. ..... 248/285; 248/176; 248/172; 248/282; 211/23

[58] Field of Search ..... 248/285, 289.1, 172, 248/310, 289.3, 486, 487, 282, 176; 211/23, 96

[56] References Cited

U.S. PATENT DOCUMENTS

| | | | |
|---|---|---|---|
| 1,637,305 | 7/1927 | Hendsch | 248/289.1 |
| 2,501,176 | 3/1950 | Jacobs | 248/316.4 X |
| 3,376,007 | 4/1968 | Chesterley | 248/282 |
| 4,270,721 | 6/1981 | Mainor, Jr. | 248/285 |

FOREIGN PATENT DOCUMENTS

| | | | |
|---|---|---|---|
| 492527 | 3/1954 | Italy | 248/486 |
| 23300 | 2/1977 | Japan | 211/26 |

*Primary Examiner*—Alvin C. Chin-Shue
*Attorney, Agent, or Firm*—Dvorak & Traub

[57] ABSTRACT

A tire display device having an arm assembly, a pivotable bracket assembly, and a plate assembly, the arm assembly comprising a wall bracket, an arm having one end secured to the wall bracket, and a free end pivotally supporting the pivotable bracket assembly for pivotable movement in a horizontal plane. The bracket assembly, in turn, supports a plate having peripheral flanges provided with slots for admitting respective slide arms having inner ends provided with threaded bores for aligning with respective radially extending slots in the plate so that a bolt can be passed through the slot into the threaded bore for adjustably securing the slide arm on the plate. The other end of the slide arm is provided with a pocket for engaging a bead on the tire. The slidable adjustability of the slide arms permit mounting of tires having different diameters. The plate is provided with a central opening for admitting a flanged bushing which is mountable on a shaft secured to a base of the pivotable bracket. The plate assembly is secured by a cotter key receivable in a bore passing through the free end of the shaft. The plate assembly is rotatable on the shaft so that a tire supported on the device can be rotated to any position to facilitate the reading of the information imprinted on the sidewall of the tire. The pivotable bracket assembly enables the tire to be pivoted in the horizontal plane to permit inspection of the tread design on the tire. The end of the shaft is provided with an advertising coverplate to fill out the tire opening and to conceal the plate assembly. The advertising coverplate is mounted in such a way as to keep it stationary when the tire is rotated.

9 Claims, 2 Drawing Sheets

TIRE DISPLAY DEVICE

BACKGROUND OF THE INVENTION

1. Field of the Invention

This invention is generally concerned with devices for displaying merchandise, and particularly to a device for supporting and displaying a tire.

2. Description of the Prior Art

The stores that sell automative merchandise, including tires, generally keep the tires on a floor standing upright and leaning against a wall. In the alternative, the tires may be mounted and supported on a bracket which is secured to a wall. Neither of the foregoing tire displays permit a customer to readily read the markings impressed on the sidewall of a tire describing the size, the rating, brandname, and other information provided by the manufacturer of the tires, or permit inspection of the tread when the tire is pivoted or rotated.

SUMMARY OF THE INVENTION

To overcome the foregoing disadvantages of tire display, there is provided a tire display device using an arm assembly having a bracket at one end for securement to a wall, and having the other end provided with a pivotable bracket assembly provided with slide arms for supporting a tire on a shaft which allows rotation of the tire, and the pivotable bracket allows the tire to be swung in a vertical plane.

The main object is to provide an arm assembly for mounting a tire which can be rotated and which can be pivoted to various positions so that markings on the sidewall of the tire can be readily read and tread design can be studied.

Another object of the invention is to pivotally support the tire which can be swung over a wide range in the vertical plane so that the inscription on the sidewall of a tire can be positionally adjusted to provide the best view of the description with respect to the light availability.

A still further object of the invention is to provide a display device capable of displaying tires of different sizes.

Another object of the invention is to provide a tire display device having an attachment for supporting an advertising sign also functioning as a coverplate for a plate assembly supporting the tire.

A tire display device has an arm assembly, a pivotable bracket assembly, and a plate assembly, the arm assembly having a wall bracket, an arm having one end secured to the wall bracket, and a free end pivotally supporting the pivotable bracket assembly, the bracket assembly having a flanged bracket, a device for pivotally securing the flanged bracket to the free end of the arm, and a shaft having one end secured to the bracket. The plate assembly has a plate having spaced peripherally located slide arm receiving members, slide arms receivable in said slide arm receiving members, members for adjustably positioning the slide arms in the slide are receiving members with respect to the plate. Various members for supporting the plate on the shaft and securing members for maintaining the plate assembly on the shaft are provided.

A tire display device having an arm assembly, a pivotable bracket assembly, and a plate assembly, the arm assembly comprising a wall bracket, an arm having one end secured to the wall bracket, and a free end pivotally supporting the pivotable bracket assembly for pivotable movement in a horizontal plane. The bracket assembly, in turn, supports a plate having peripheral flanges provided with slots for admitting respective slide arms having inner ends provided with threaded bores for aligning with respective radially extending slots in the plate so that a bolt can be passed through the slot into the threaded bore for adjustably securing the slide arm on the plate. The other end of the slide arm is provided with a pocket for engaging a bead on the tire. The plate is provided with a central opening for admitting a flanged bushing which is mountable on a shaft secured to a base of the pivotable bracket. The plate assembly is secured by a cotter key receivable in a bore passing through the free end of the shaft. The plate assembly is rotatable on the shaft so that a tire supported on the device can be rotated to any position to facilitate the reading of the information imprinted on the sidewall of the tire. The pivotable bracket assembly enables the tire to be pivoted in the horizontal plane to permit inspection of the tread design on the tire. The end of the shaft is provided with an advertising coverplate to fill out the tire opening and to conceal the plate assembly.

Other objects and advantages of the invention will become apparent as the description proceeds in accordance with the drawings.

DESCRIPTION OF THE PREFERRED EMBODIMENT

Figure 1:
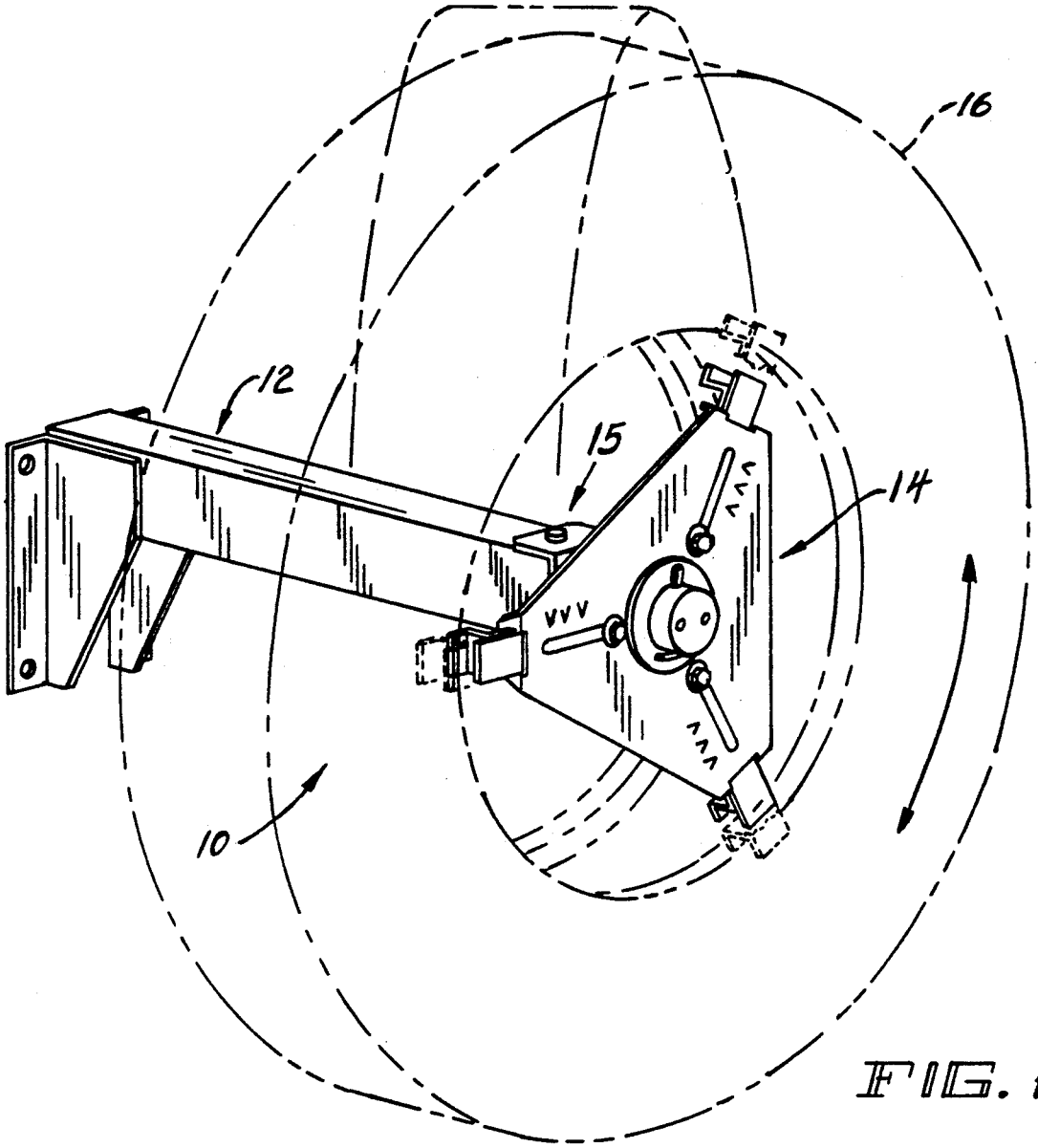
FIG. 1 is a perspective view of a tire display device adapted to support a tire.

Referring to FIG. 1, there is disclosed a tire display device 10 having an arm assembly 12, a plate assembly 14 and bracket assembly 15 for pivotally supporting a tire 16 shown in phantom.

Figure 2:
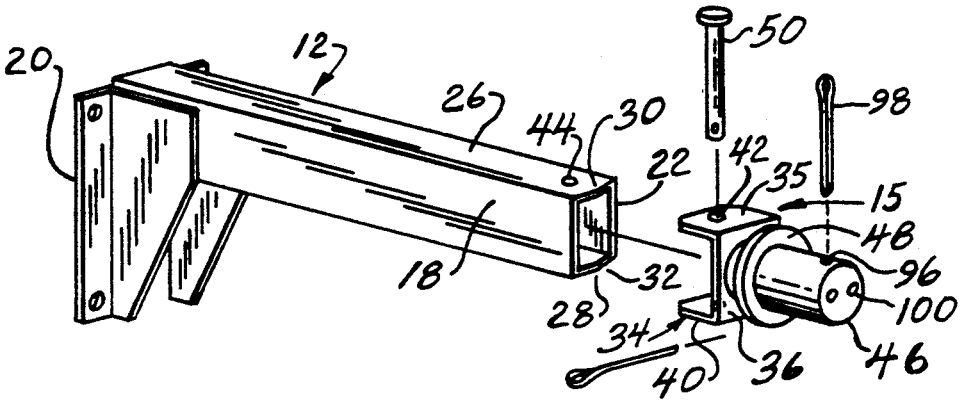
FIG. 2 is a perspective view of an arm assembly for supporting the tire.
Figure 4:
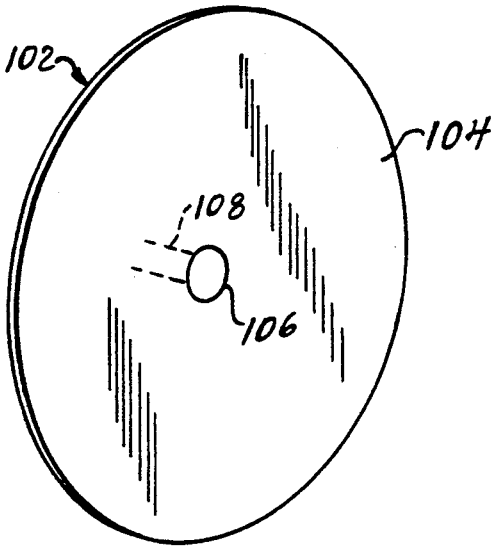
FIG. 4 is a perspective view of an advertising coverplate for filling out the opening in the tire.

Referring to FIG. 2, the arm assembly 12 has an arm 18 having one end secured to a bracket 20 which is adapted to be mounted on a wall surface and other end 22 is adapted to support the bracket assembly 15. The arm 18 is tubular and has a rectangular cross-section wherein upper and lower walls 26 and 28, respectively, are slightly cutaway to define apices 30 and 32, respectively, the purpose of which will be described later. The bracket assembly 15 comprises a pivotal bracket 34 having a base 36 provided with a pair of opposed flanges 38 and 40 provided with apertures 42 which are adapted to align with apertures 44 adjacent the end 22 in the arm 18 when the flanges are slipped over the upper and lower walls 26 and 28 of the arm 18. Secured to the base 36 is a shaft 46 provided with a collar 48. As an alternative arrangement, the collar 48 can be dispensed with and replaced by a thick wide-rimmed washer to abut the base 36. When the pivotal bracket 34 is mounted on the end 22 of the arm 18, a clevis pin 50 is inserted into the aligned apertures 42 and 44 to provide a pivotal movement in a horizontal plane of the shaft 46. To prevent accidental removal of the clevis pin 50, the clevis pin is secured by a cotter pin 52.

Figure 3:
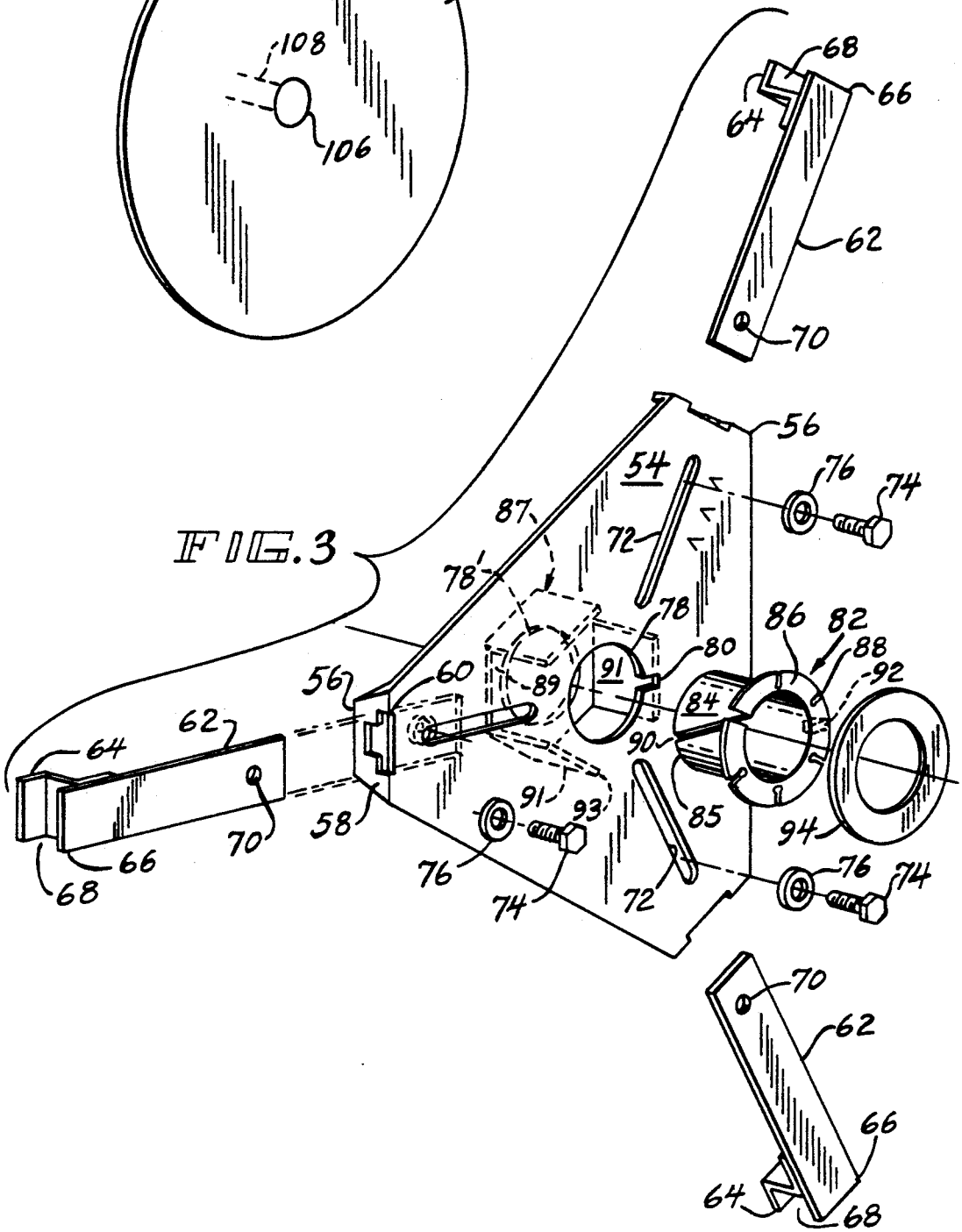
FIG. 3 is an enlarged exploded view of the components comprising a plate assembly for supporting the tire.

The plate assembly 14 shown in FIG. 3 comprises a plate 54 having essentially a triangular configuration with truncated apices 56 which have bent portions or flanges 58 containing slots 60 for slidably admitting slide arms 62, a free end of each slide arm being provided with a transversely-extending, "L"-shaped finger 64 which, together with an end 66, defines a pocket 68 adapted to receive the bead of a tire. The other end of the slide arm 62 is provided with a threaded aperture 70. When the slide arm 62 is inserted into its respective slot 60, the aperture 70 will be exposed through a slot 72 in the plate 54 so that a bolt 74 passing through a lock washer 76 can engage with the aperture 70 in the arm 62 and fasten the arm in a particular position on the plate 54.

The center of the plate 54 has an opening 78 provided with a notch 80 for receiving a flanged bushing 82 which has a cylindrical body 84 having one end terminating in a flange 86 which has a plurality of slots 88. The flanged bushing 82 is preferably made from plastic material. An angular slot 90 extends through the cylindrical body 84 and the flange 86 so that the flanged bushing 82 can be slightly compressed to reduce the cylindrical periphery of the body 84 to permit insertion into the opening 78 in the plate 54. Extending out of the outer surface of the cylindrical body 84 and the flange 86 is a tooth 92 which will engage with the notch 80 and thereby prevent rotational movement of the flanged bushing 82.

To provide support for inner end 85 of the flanged bushing 82, there is provided, on the rear side of the plate 54, a bracket 87 having a base 89 with an opening 78' aligned with the opening 78, and three flanges 91 having ends 93 secured to the plate 54. The cylindrical body 84 of the flanged bushing 82 is long enough to extend into the opening 78' to provide a two-point support for the flanged bushing 82.

After the flanged bushing 82 is inserted into the opening 78 in the plate 54, the plate assembly is mounted on the shaft 46. Since the length of the shaft 46 is greater than the depth of the flanged bushing 82, the protruding end of the shaft 46 will receive a washer 94 which is pushed on the shaft until it passes an aperture 96 adjacent the end of the shaft to permit the insertion of a cotter pin 98 into the aperture 96 to thereby secure the plate assembly 14 to prevent accidental removal of the plate assembly. The end of the shaft 46 is provided with a pair of holes 100 which serve to accept and support a coverplate 102, having an advertising sign 104, provided with a cap 106 having a pair of spaced pins 108. The advertising sign 104 is secured to the coverplate 102 with adhesive. Alternatively, the coverplate 102 can be replaced by the advertising sign 104 made from cardboard provided on its back with spaced pins 108. Other arrangements are also possible.

As clearly indicated in FIG. 3, any size automobile tire can be accommodated on the plate assembly 14 by moving or sliding the slide arms 62 to conform to the inner diameter of the tire.

As various changes could be made in the above construction, without departing from the scope of the invention, it is intended that all matter contained in the above description or shown in the accompanying drawings shall be interpreted as illustrative and not in a limiting sense.

What is claimed is:

1. A tire display device comprising an arm assembly, a pivotable bracket assembly, and a plate assembly, said arm assembly comprising a wall bracket, an arm having one end secured to said wall bracket and a free end pivotally supporting said pivotable bracket assembly, said bracket assembly comprising a flanged bracket, means for pivotally securing said flanged bracket to said free end of the arm, and a shaft having one end secured to said bracket, said plate assembly comprising a plate having spaced peripherally located slide arm receiving means, slide arms receivable in said slide arm receiving means, means for adjustably positioning said slide arms in said slide arm receiving means with respect to said plate, means for rotatably supporting said plate on said shaft, and means for securing said plate assembly on said shaft, said means for adjustably positioning the slide arms including at least two elongated slots extending substantially over a distance between said means for rotatably supporting said plate and said slide arm receiving means.

2. A device according to claim 1, wherein each of said slide arm receiving means comprises a flange bent 90° from the planar surface of the plate, said flange having a slot having one side congruent with said planar surface of said plate, said slide arm being receivable in said slot, said means for adjustably positioning said slide arms comprise spaced radially outwardly extending slots in said plate, a threaded bore in one end of each arm and aligned with a respective extending slot, and a bolt extending through said extending slot and engaged with said threaded bore for adjustably securing said respective arm to said plate.

3. A device according to claim 1, wherein said means for securing said flanged bracket to the free end of the arm comprises a pair of spaced flanges extending from a base of said bracket, said flanges provided with spaced and aligned apertures, said free end of the arm provided with angled faces, spaced and aligned apertures passing vertically adjacent said angled faces, and a clevis pin passing through said aligned apertures for pivotally supporting said flanged bracket for movement in a horizontal plane.

4. A device according to claim 1, wherein the free end of each slide arm is provided with pocket means for receiving a bead of a tire, the slide arms and their associated pockets being adjustably positioned with respect to the plate for accommodating different diameter sized tires.

5. A device according to claim 4, wherein each slide arm has an end extending outwardly from the plate, said each end being provided with an off-set finger to define with said free end a pocket adapted to receive a bead on the tire, all of said slide arms being adjustable to accommodate the diameter of the bead of the tire.

6. A device according to claim 1, wherein free end of said shaft is provided with means for supporting an advertising coverplate for concealing the plate assembly.

7. A tire display device comprising a wall bracket, an arm having one end secured to said wall bracket and a free end for pivotally supporting a bracket having a pair of spaced flanges provided with a pair of aligned apertures, said free end of the arm having a pair of spaced angled faces and a pair of spaced aligned apertures passing through said arm adjacent said angled faces, a clevis pin passing through said aligned apertures, a shaft having one end secured to said flanged bracket, a plate assembly mountable on said shaft, said plate assembly having a plate having spaced peripherally located flanges bent 90° from the planar source of the plate, each of said flanges having a slot, a slide arm associated and being receivably in said slot, a radially outwardly extending slot in said plate associated with each slide arm, a threaded bore in one end of the arm and aligned with the respective extending slot, a bolt extending through said extending slot and engaged with said threaded bore for adjustably securing said respective slide arm to said plate, an opening centrally located in said plate, a flanged bushing receivable in said central opening and mountable on the free end of the shaft, a washer abutting the flanged portion of said bushing, a diametrical bore passing through the adjacent free end of said shaft, and a cotter key receivable in said diametrical bore and abutting the washer.

8. A device according to claim 7, wherein free end of said shaft is provided with means for supporting an advertising coverplate for concealing the plate assembly.

9. A tire display device comprising an arm assembly, a pivotable bracket assembly, and a plate assembly, said arm assembly comprising a wall bracket, an arm having one end secured to said wall bracket and a free end pivotally supporting said pivotable bracket assembly, said bracket assembly comprising a flanged bracket, means for pivotally securing said flanged bracket to said free end of the arm, and a shaft having one end secured to said bracket, said plate assembly comprising a plate having spaced peripherally located slide arm receiving means, slide arms receivable in said slide arm receiving means, means for adjustably positioning said slide arms in said slide arm receiving means with respect to said plate, means for rotatably supporting said plate on said shaft, and means for securing said plate assembly on said shaft, wherein said means for rotatably supporting said plate comprises a central opening in said plate, and a flanged bushing receivable in said opening and mounted on said shaft, and the flange on said bushing is provided with spaced radially extending slots, and a slot extends completely through a cylindrical body of said bushing, said slot extending diagonally from the flange to the opposite end of said cylindrical body.

* * * * *